US005163227A

United States Patent [19]

Wolf et al.

[11] Patent Number: 5,163,227

[45] Date of Patent: Nov. 17, 1992

[54] EXCHANGEABLE FRAME FOR A SHAVING APPARATUS

[75] Inventors: Jürgen Wolf, Kriftel; Wolfgang Franke, Langen, both of Fed. Rep. of Germany

[73] Assignee: Braun Aktiengesellschaft, Frankfurt, Fed. Rep. of Germany

[21] Appl. No.: 758,804

[22] Filed: Sep. 12, 1991

[30] Foreign Application Priority Data

Sep. 15, 1990 [DE] Fed. Rep. of Germany ..... 4029377

[51] Int. Cl.[5] ..... B26B 19/02; B26B 19/04; B26B 19/28

[52] U.S. Cl. ..... 30/43.92; 30/43.91; 30/43.2

[58] Field of Search ..... 30/43.2, 43.9, 43.91, 30/43.92, 346.51

[56] References Cited

U.S. PATENT DOCUMENTS

| | | | |
|---|---|---|---|
| 3,440,725 | 4/1969 | Messinger et al. . | |
| 3,566,473 | 3/1971 | Locke et al. | 30/43.92 |
| 3,594,902 | 7/1971 | Otto et al. | 30/43.92 |
| 3,646,673 | 3/1972 | Yamaoka | 30/43.92 |
| 4,081,902 | 4/1978 | Locke | 30/43.92 |
| 4,292,737 | 10/1981 | Packham | 30/43.92 |
| 4,707,916 | 11/1987 | Kness et al. | 30/43.92 |
| 4,825,542 | 5/1989 | Locke | 30/43.92 |

FOREIGN PATENT DOCUMENTS

| | | |
|---|---|---|
| 1553811 | 4/1971 | Fed. Rep. of Germany . |
| 2019746 | 11/1971 | Fed. Rep. of Germany . |
| 2216069 | 8/1974 | France . |
| 51-129353 | 11/1976 | Japan . |
| 53-56557 | 5/1978 | Japan . |

*Primary Examiner*—Douglas D. Watts
*Assistant Examiner*—Paul M. Heyrana, Sr.
*Attorney, Agent, or Firm*—Fish & Richardson

[57] ABSTRACT

The invention is directed to an exchangeable frame for the shaving head of a dry shaving apparatus, comprising two longitudinal frame members in parallel arrangement and end walls connecting the longitudinal frame members at their respective ends, as well as at least one shaving foil which is carried on inwardly protruding projections provided on the two longitudinal frame members by means of suspension openings and is shaped to an arched twin head shaving foil cutter by means of another longitudinal frame member extending parallel to the two longitudinal frame members and connecting the end walls. A stepped shoulder formed on the projections provides at least one abutment surface and a pin, and the abutment surface is at a predetermined relative distance to the inner wall of the shaving foil slidably resting against the longitudinal frame members. The suspension openings are greater in vertical and horizontal direction than the contours of the projections. Each of the two longitudinal frame members has associated to it a mounting plate extending parallel thereto with openings for receiving the pins, with the mounting plate resting against the abutment surfaces and being attached to the pins. The respective mounting plate protrudes in horizontal direction beyond the boundaries of the suspension openings of the shaving foil.

14 Claims, 3 Drawing Sheets

EXCHANGEABLE FRAME FOR A SHAVING APPARATUS

This invention relates to an exchangeable frame for a shaving apparatus, comprising two longitudinal frame members in parallel arrangement and end walls connecting the longitudinal frame members at their respective ends, as well as at least one shaving foil which is carried on inwardly protruding projections provided on the two longitudinal frame members by means of suspension openings and is shaped to an arched twin head shaving foil cutter by means of another longitudinal frame member extending parallel to the two longitudinal frame members and connecting the end walls.

From JP-A 51/129353, a dry shaving apparatus having a shaving foil attached to a shaving head frame in arched form is known. In the area of its two longitudinal edges, the shaving foil is provided with a respective pair of openings by means of which it is detachably carried on hooks protruding inwardly from the two longitudinal frame members of the shaving head frame. Beneath the hooks, projections are formed on the longitudinal frame members of the shaving head frame, which projections, owing to abutting engagement with the lower side edges of the shaving foil in hooked-in condition, prevent the shaving foil both from slipping off the hooks and from receding along the wall of the longitudinal frame members in the direction of the housing of the dry shaver. In combination with the shaving pressure exerted on the shaving foil, arranging for the shaving foil to take support on the projections causes the shaving foil to become bulged. The relatively thin and flexible shaving foil is not in a position to withstand such a load in the long run. Due to the bulging effect, the shaving foil will disengage itself from the hooks, or alternatively rupture will occur in the load range.

In addition, a dry shaving apparatus is known having two shaving foils attached to an exchangeable frame in arched form. The exchangeable frame is comprised of two longitudinal frame members in parallel arrangement and end walls interconnecting the longitudinal frame members at their respective ends, as well as two shaving foils which are suspended in, and supported on, inwardly protruding hooks and projections on the two longitudinal frame members. An intermediate member which extends parallel to the longitudinal frame members and connects the end walls and to which also the two shaving foils are attached causes the two shaving foils to assume an arched shape, thereby providing a twin head shaving foil cutter. An exchangeable of this type is obviously prior used by an applicant's shaving apparatus.

It is an object of the present invention to provide a suspension structure for a twin head shaving foil cutter which improves the shaving performance of the shaver assembly and prolongs the service life of the twin head shaving foil cutters. According to the present invention, this object is accomplished in that at least one stepped shoulder formed on the projections provides an abutment surface and a pin, that the abutment surface is at a predetermined relative distance to the inner wall of the shaving foil slidably resting against the longitudinal frame members, that the suspension openings are greater in vertical and horizontal direction than the contours of the projections, that each of the two longitudinal frame members has associated to it a mounting plate extending parallel thereto with openings for receiving the pins, that the mounting plate rests against the abutment surfaces and is attached to the pins, and that the respective mounting plate protrudes in horizontal direction beyond the boundaries of the suspension openings of the shaving foil.

Mounting a twin head shaving foil cutter in this manner ensures a perfect receding motion of the shaving foil along the inner walls of the longitudinal members of the exchangeable frame, which motion is caused by the shaving pressure acting on the foil, accordingly providing for an optimum cooperative relation with the inner cutters of the shaving apparatus. The mounting plates resting against the abutment surfaces of the projections and fastened to the projections by means of pins, in combination with the predetermined relative distance of the abutment surfaces to the respective inner wall of the longitudinal frame members, serve the function of providing a load-free suspension and movement of the shaving foil, thus contributing significantly to a longer service life of the shaving foil.

In an embodiment of the present invention, the mounting plate is of a plane structure on either side. In this embodiment, the magnitude of the relative distance x of the abutment surface to the inner wall of the longitudinal frame member is determined by the thickness of the shaving foil and by the predetermined relative distance a of the inner wall of the shaving foil to the opposite wall of the mounting plate.

In an advantageous embodiment of the invention, the mounting plate is of a profiled structure. Preferably, the mounting plate is profiled in U-shape in order to increase the stiffness of the relatively thin mounting plate. In the use of a mounting plate profiled in U-shape, the magnitude of the relative distance x of the abutment surface to the inner wall of the longitudinal frame member is determined by the thickness of the shaving foil and by the predetermined relative distance of the inner wall of the shaving foil to the opposite wall of the mounting plate, and by the relative distance of the abutment surface of the mounting plate with the abutment surface of the projection to the wall of the mounting plate, which distance results from the profiled structure of the mounting plate.

Advantageous and suitable embodiments of the projections of the invention employ a stepped shoulder that provides an abutment surface that extends in horizontal direction and from which a pin protrudes. By deforming the pins, the respective mounting plate is fastened to the pin in abutting engagement with the abutment surfaces. This may be accomplished in a simple manner by a fusing or riveting operation performed on the pins.

In a preferred embodiment of the invention, bearing surfaces for the mounting plates extending beyond the respective longitudinal sides of the shaving foil are formed on the longitudinal frame members in the area of the end walls. This additional support for the mounting plates facilitates their assembly and fastening in the riveting or fusing operation and ensures a uniform relative distance of the mounting plate to the shaving foil.

In an advantageous embodiment of the invention, the shaving foil or the shaving foils of the twin head shaving foil cutter are immovably held on the longitudinal frame member in the horizontal direction, while being movably held thereon in the vertical direction, and the receding depth of the shaving foil or shaving foils on the inner wall of the longitudinal frame members is determined by the vertical relative distance of the rim of the suspension openings to the upper side of the projections.

In a further embodiment of the invention, the shaving foil or the shaving foils of the twin head shaving foil cutter are immovably fastened to the longitudinal frame member, and the receding depth of the shaving foil or shaving foils on the inner wall of the longitudinal frame members is determined by the vertical relative distance of the rim of the suspension openings to the upper side of the projections.

Some embodiments of the invention will now be described in the following with reference to the accompanying drawings, in which.

Figure 1:
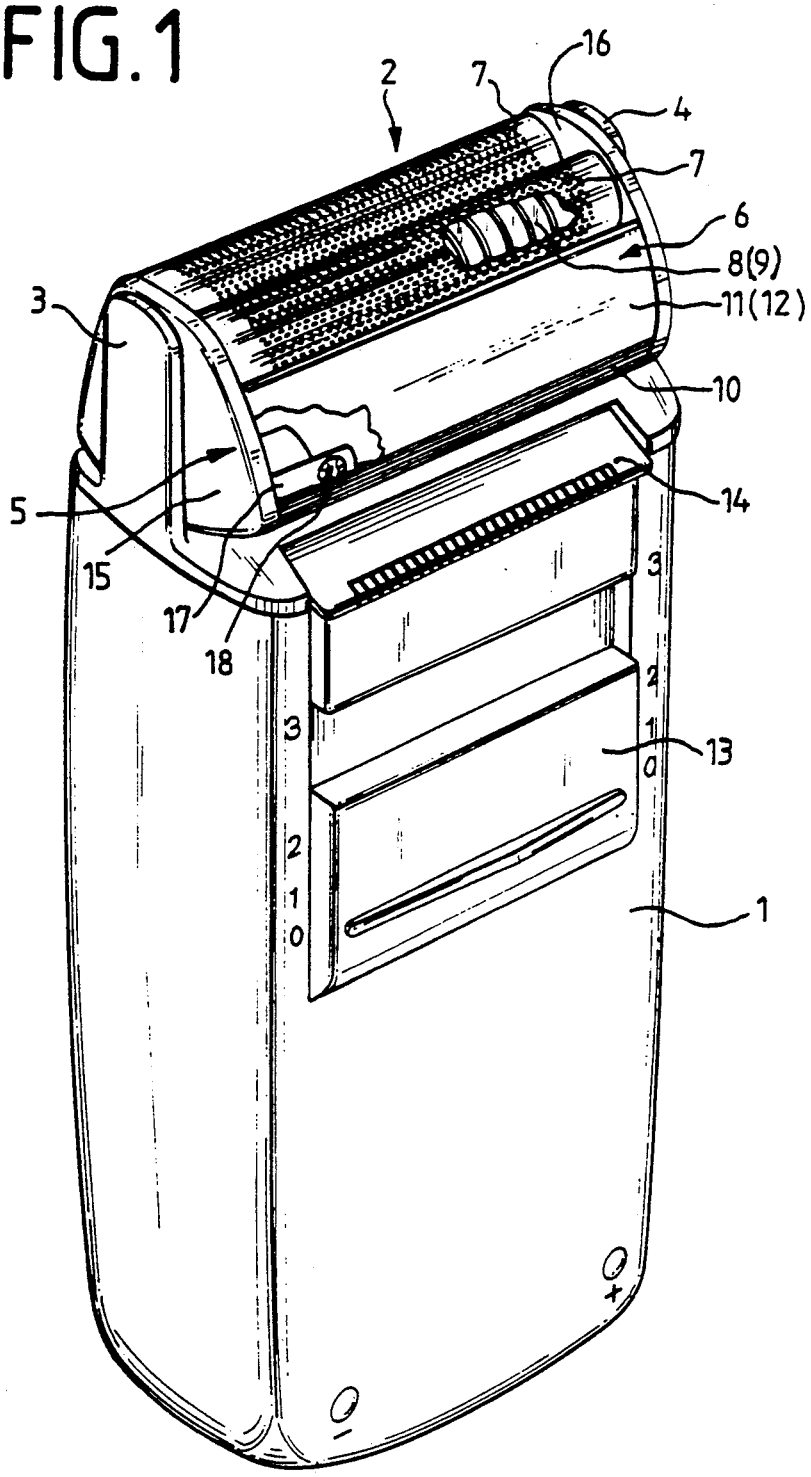
FIG. 1 is perspective view of a shaving apparatus equipped with a twin head shaving foil cutter.

Referring now to FIG. 1, there is shown an electric dry shaving apparatus having pivotally mounted on its housing 1 a shaving head 2 carried between two bracket arms 3 and 4. The shaving head 2 is comprised of a shaving head frame structure 5 and an exchangeable frame 6 removably attached thereto and including a twin head shaving foil cutter. Beneath the double-arched shaving foil 7 which may be made of one or two parts, two inner cutters 8, 9 are provided of which the inner cutter 8 is shown, a portion of the shaving foil having been cut away for that purpose. The exchangeable frame 6 is disposed between the end walls 15, 16 of the shaving head frame structure 5 and detachably held by locking means 18 arranged in its sides 17, as shown, by way of example, in the cut-away portion on the exchangeable frame 6.

Figure 2:
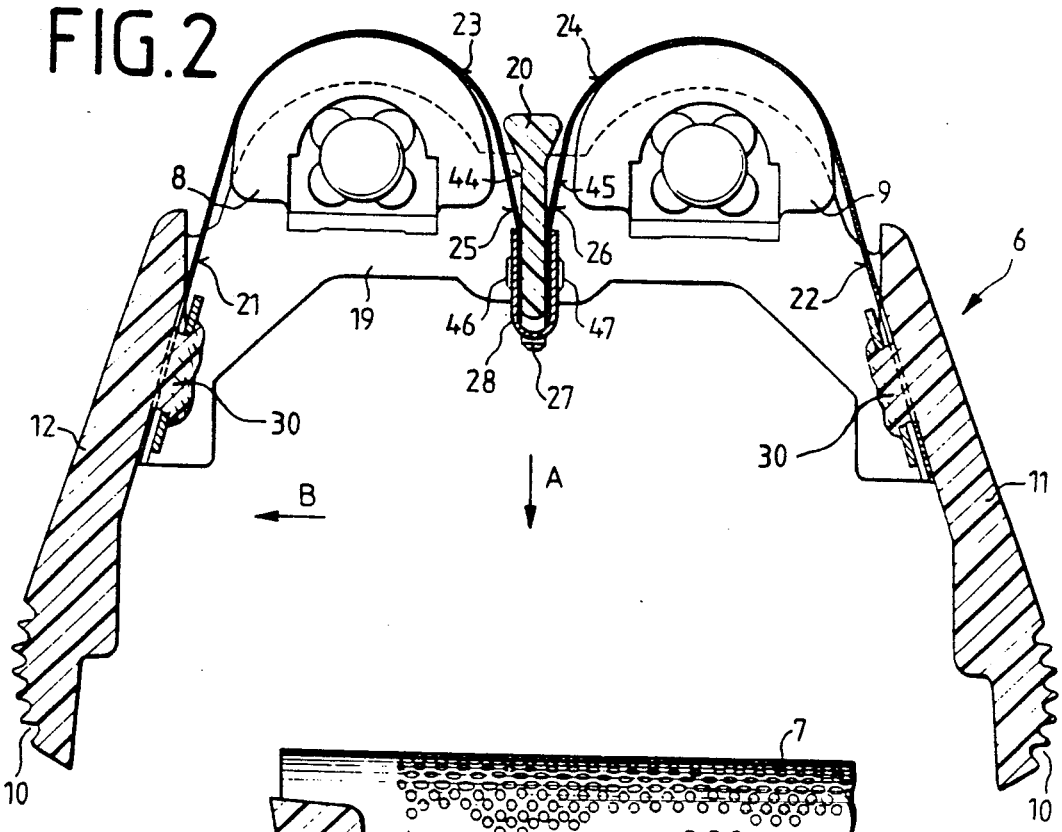
FIG. 2 is a sectional view of an exchangeable frame with a twin head shaving foil cutter and an inner cutter operatively associated therewith.

The ribbing 10 provided on the outsides of the longitudinal frame members 11, 12 of the exchangeable frame 6—see FIG. 2—facilitates coupling and decoupling of the exchangeable frame 6 to and from the shaving head frame structure 5. For operation of the inner cutters 8, 9 by an electrical drive means arranged in the housing 1, an on/off switch 13 operatively associated with a long-hair trimmer 14 is disposed on the front panel of the shaving apparatus.

FIG. 2 shows a cross-sectional view of the exchangeable frame 6 of FIG. 1. The inner cutters 8, 9 additionally shown in this Figure serve for a better understanding of the configuration of the twin head shaving foil cutter and its fastening to the exchangeable frame 6 as well as the cooperative relation of these components.

The exchangeable frame 6 is comprised of a frame means formed of two longitudinal frame members 11, 12 in parallel arrangement, and end walls 19—of which only one is shown in FIG. 2—connecting the two longitudinal frame members at their respective ends, as well as another longitudinal frame member 20 disposed between, and extending parallel to, the longitudinal frame members 11 and 12 and integrally formed with the end walls 19, and a twin head shaving foil cutter attached in arched form, the two longitudinal sides 21, 22 of which are held on the longitudinal frame members 11 and 12, respectively.

In the embodiment of FIG. 2, the twin head shaving foil cutter comprises two shaving foils 23, 24, the outer longitudinal sides 21, 22 of which are slidably held on the longitudinal frame members 11, 12 and the longitudinal inner sides 25, 26 of which are attached to the longitudinal frame member 20 so as to be immovable both in the direction of oscillation of the spring-mounted inner cutters 8, 9 and in the vertical direction-arrow A.

For this purpose, pins 27, 46, 47 are integrally formed on the two longitudinal sides 44, 45 and on the side walls of the longitudinal frame member 20. These pins pass through suitable openings provided in a U-shaped mounting bracket 28, thereby locking the shaving foil in both vertical and horizontal direction. The mounting bracket 28 is connected fast with the longitudinal frame member 20 by fusing the pins 46 and 47. The twin head shaving foil cutter may also be a one-part structure. In such an embodiment, the shaving foil is guided around the longitudinal frame member 20. The pins 46, 47, 27 extend through suitable openings provided in the one-part shaving foil, with the pins and their openings in the shaving foil being shaped such as to ensure only a vertical receding motion in the direction of arrow A, but no movement in the direction of oscillation of the inner cutters 8, 9.

For example, the openings in the shaving foil through which the pins 46 and 47 extend may be configured as vertically extending elongate holes, their vertical longitudinal extent corresponding to the receding motion of the shaving foil.

Figure 3:
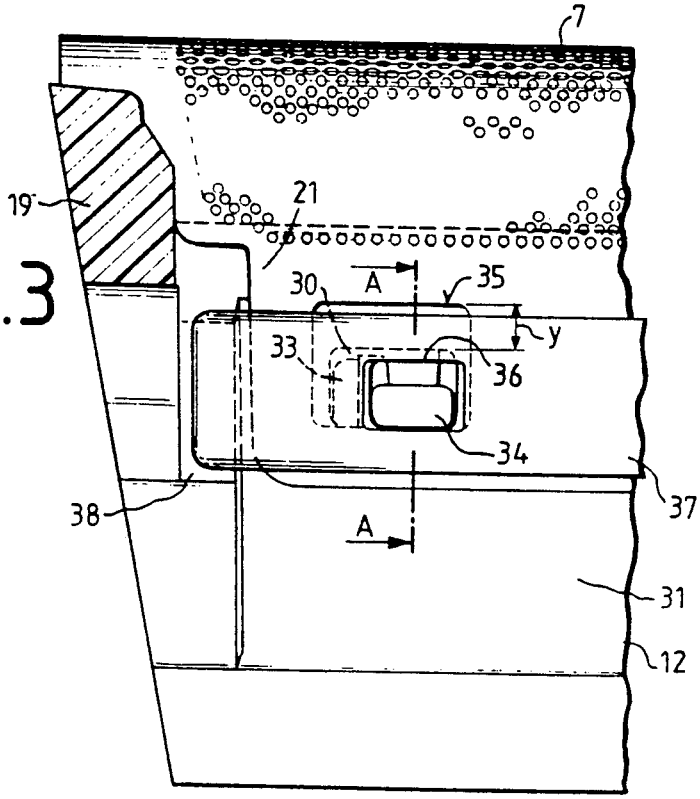
FIG. 3 is a view of one half of the inner wall of an exchangeable frame, viewed in the direction of arrow B of FIG. 2.

The fastening of the shaving foils 23, 24 of FIG. 2 or of the shaving foil 7 to the longitudinal frame members 11 and 12 of the exchangeable frame 6 by means of at least two projections 30 formed on the inner walls 31, 32 of the respective longitudinal frame members 11, 12 will be described in greater detail in the following with reference to FIGS. 3, 4 and 5. When viewed in the direction of arrow B of FIG. 2, FIG. 3 shows one half of the inner wall 31 of the longitudinal frame member 12, with a projection 30 integrally formed thereon at a relative distance to the end wall 19, shown in section, of the exchangeable frame 6. The projection 30 is of a stepped configuration for the purpose of providing an abutment surface 33 and a pin 34. The longitudinal side 21 of the shaving foil 7 spanning the end wall 19 in arched form has at its end in the area of the longitudinal frame member 12 a stepped shoulder in the direction of the projection 30. In the end area of the stepped shoulder of the shaving foil 7, a rectangular suspension opening 35 is provided in its longitudinal side 21, its cross section of aperture being dimensioned larger than the contour of the projection 30 on the longitudinal frame member 12 in both the vertical and the horizontal direction. With the bottom edge of the suspension opening 35 in abutting engagement with the bottom edge of the projection 30, there thus results a relative distance y of the upper edge of the suspension opening 35 to the upper edge of the projection 30. The magnitude of this distance y is governed by the receding motion of the shaving foil 7 movably held on the longitudinal frame members 11, 12 as required for the shaving head of a dry shaving apparatus.

The relative distance of the abutment surface 33 to the inner wall 31 of the longitudinal frame member 12 is greater than the thickness d of the shaving foil 7. As a result, the mounting plate 37 which is provided with an opening 36 and is slipped onto the pin 34 engages the abutment surface 33. The mounting plate 37 thus seated onto the projection is subsequently fastened in abutting engagement with the abutment surface 33 by means of a fusing or riveting operation performed on the pin 34. In a further embodiment, respective bearing surfaces 38 for the mounting plate 37 extending beyond the longitudinal sides 21 are formed on the respective ends of the longitudinal frame members 11 and 12 adjacent to the end walls 19 and to the stepped shoulder of the longitudinal sides 21 of the shaving foil 7, with the respective areas of the bearing surfaces 38 and abutment surfaces 33 of the projections lying in a common plane. For example, in the presence of two projections 30 provided on the respective longitudinal frame members 11 and 12, the respective mounting plate 37 rests against a total of four surfaces, namely, two abutment surfaces 33 and two bearing surfaces 38, causing the mounting plate to be accurately located and stabilized. Moreover, this abutment with four bearing surfaces facilitates the fastening of the mounting plates 37 to the projections 30.

Figure 4:
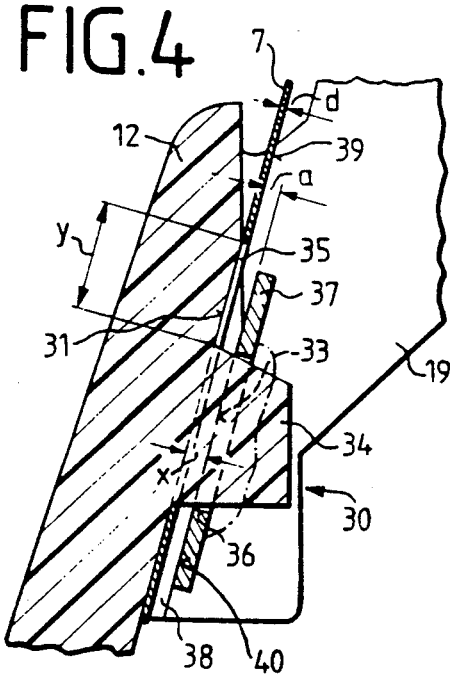
FIG. 4 is a sectional view of a longitudinal frame member, taken along the line A—A of FIG. 3, with a mounting plate having a plane structure.
Figure 5:
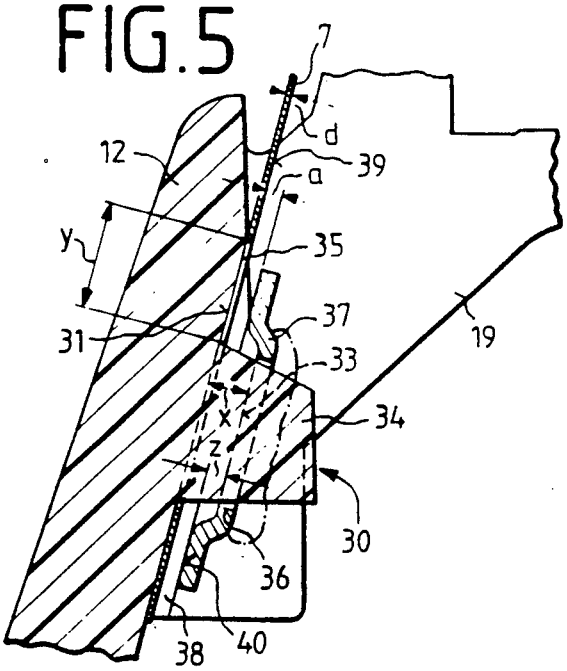
FIG. 5 is a sectional view of a longitudinal frame member, taken along the line A—A of FIG. 3, with a mounting plate profiled in U-shape.

FIGS. 4 and 5 are sectional views, along the line A—A, of the longitudinal frame member 12, the shaving foil 7, the projection 30 and the mounting plate 37. The projection 30 integrally formed on the inner wall 31 of the longitudinal frame member 12 is of a trapezoidal shape, extending through the suspension opening 35 of the shaving foil 7 resting against the inner wall 31, while its pin 34 is passed through the opening 36 in the mounting plate 37. In both embodiments, the mounting plate 37 rests against the abutment surface 33, shown in broken lines, of the projection 30, while its end rests against the bearing surface 38—see FIG. 3. The magnitude of the relative distance x of the abutment surface 33 to the inner wall 31 of the longitudinal frame member 12 is determined by the thickness d of the shaving foil 7 plus a predetermined relative distance a of the inner wall 39 of the shaving foil 7 to the opposite wall 40 of the plane mounting plate 37. Where a mounting plate 37 profiled in U-shape is used—as shown in FIG. 5—the depth z resulting from the U-shape has to be added. Following abutting engagement of the mounting plate 37 with the abutment surface 33, the mounting plate 37 is fastened to the projection 30, for example, by subjecting the pin 34 to a fusing or riveting operation, as illustrated in FIGS. 4 and 5 by the broken line. By means of the mounting plates 37, the shaving foil 7 is thus movably fastened to the projections 30 formed on the longitudinal frame members 11 and 12. The vertical receding motion of the shaving foil 7 by the amount y along the inner walls 31 of the longitudinal frame members 11, 12 is ensured by suitably dimensioning the suspension opening 35 and the contours of the projections 30 on the one hand, and by the relative distance a of the inner wall 39 of the shaving foil 7 to the opposite wall 40 of the mounting plate 37 on the other hand.

Figure 6:
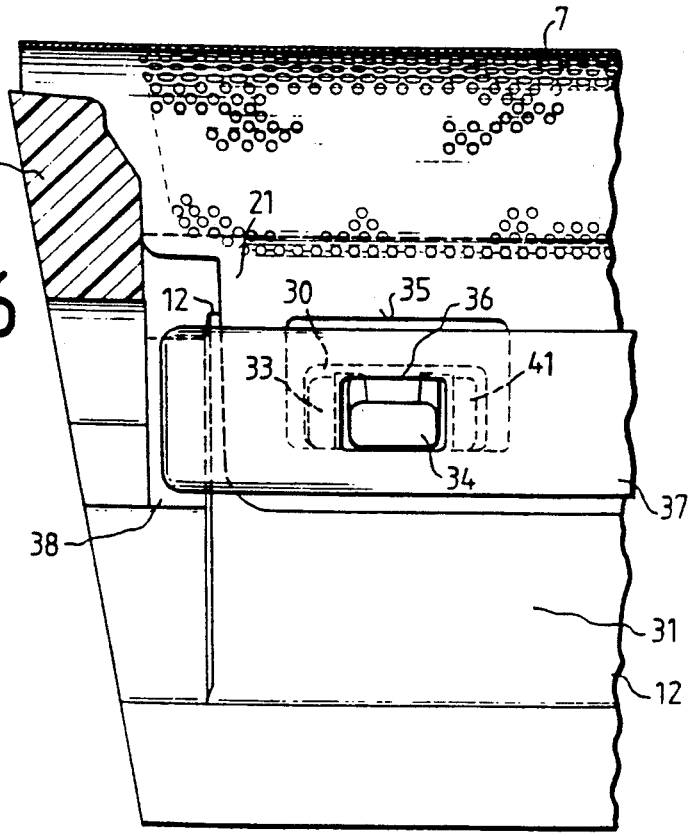
FIG. 6 is a view of one half of the inner wall of an exchangeable frame, viewed in the direction of arrow B of FIG. 2, but with two abutment surfaces on a projection.

In a modified embodiment illustrated in FIG. 6, two stepped shoulders each are provided on the projections 30, being separated from each other by a respective pin 34. This results in two abutment surfaces 33, 41 extending in horizontal direction and a pin 34 protruding relative to these surfaces, its length being greater than the thickness of the mounting plate 37 arranged on the pin 34. Subsequently, the mounting plate 37 resting against the abutment surfaces 33, 41 is fastened to the projections 30 by riveting or fusing the respective pin 34.

We claim:

1. An exchangeable frame for the shaving head of a dry shaving apparatus, comprising two main longitudinal frame members in parallel arrangement, end wall structures connecting said main longitudinal frame members at their respective ends, a supplemental longitudinal frame member extending parallel to and between said two main longitudinal frame members and connected to said end wall structures, inwardly protruding projections on said two main longitudinal frame members, arched twin head cutter structure, at least one shaving foil shaped to said arched twin head cutter structure and including edge portions with suspension openings therein, each said edge portion of said shaving foil slidably resting against an adjacent one of said main longitudinal frame members, and an intermediate portion of said shaving foil in engagement with said supplemental frame member, at least one stepped shoulder portion formed on each said projection to provide an abutment surface and a pin, each said abutment surface being spaced at a predetermined relative distance (x) to the inner wall of an adjacent one of said main longitudinal frame members, said suspension openings being greater in vertical and horizontal dimension than the contours of said pins, a mounting plate associated with each said main longitudinal frame member and extending parallel thereto with openings for receiving said pins, each said mounting plate resting against said abutment surfaces and being attached to said pins, and each said mounting plate protruding in horizontal direction beyond the boundaries of said suspension openings of said shaving foil.

2. The exchangeable frame as claimed in claim 1 wherein each said mounting plate has opposed planar surfaces.

3. The exchangeable frame as claimed in claim 2 wherein the magnitude of the distance (x) is determined by the thickness (d) of said shaving foil and by the predetermined relative distance (a) of the inner wall of said shaving foil to the adjacent surface of said mounting plate.

4. The exchangeable frame as claimed in claim 1 wherein each said mounting plate is of profiled configuration.

5. The exchangeable frame as claimed in claim 4 wherein said mounting plate is U-shape in profile.

6. The exchangeable frame as claimed in claim 4 or claim 5 wherein the magnitude of the distance (x) is determined by the thickness (d) of said shaving foil, by the predetermined relative distance of the inner wall of said shaving foil to the adjacent wall surface of said mounting plate, and by the relative distance (z) of the surface of said mounting plate in abutment with the abutment surface of said projection to said wall of said mounting plate, which distance (z) results from the profiled structure of said mounting plate.

7. The exchangeable frame as claimed in claim 1 wherein the stepped shoulder portion of each said projection provides a said abutment surface extending in horizontal direction and said pin protrudes relative thereto and has a length greater than the thickness of said mounting plate attached to said pin.

8. The exchangeable frame as claimed in claim 1 wherein each of said projections includes two of said stepped shoulder portions that provide two abutment surfaces extending in horizontal direction and said pin protrudes relative thereto and has a length greater than the thickness of said mounting plate attached to said pin.

9. The exchangeable frame as claimed in claim 7 or claim 8 wherein the respective mounting plates are fastened to said pins and are held in abutting engagement with said abutment surfaces by deforming said pins.

10. The exchangeable frame as claimed in claim 1 and further including bearing surface structure for said mounting plates extending beyond the respective longitudinal sides of said shaving foil, said bearing surface structure being formed on said longitudinal frame members in the area of said end wall structures.

11. The exchangeable frame as claimed in claim 1 wherein said shaving foil of said twin head cutter structure is immovably held on said main longitudinal frame members in the horizontal direction, while being movably held thereon in the vertical direction, and the receding depth (y) of said shaving foil on the inner walls of said main longitudinal frame members is determined by the vertical relative distance (y) of the upper edges of said suspension openings to the upper sides of said projections.

12. An exchangeable frame for the shaving head of a dry shaving apparatus, comprising two main longitudinal frame members in parallel arrangement, end wall structures connecting said main longitudinal frame members at their respective ends, a supplemental longitudinal frame member extending parallel to and between said two main longitudinal frame members and connected to said end wall structures, inwardly protruding projections on said two main longitudinal frame members, arched twin head cutter structure, at least one shaving foil shaped to said arched twin head cutter structure and including edge portions with suspension openings therein, each said edge portion of said shaving foil slidably resting against an adjacent one of said main longitudinal frame members, and an intermediate portion of said shaving foil immovably fastened to said supplemental frame member, at least one stepped shoulder portion formed on each said projection to provide an abutment surface and a pin, each said abutment surface being spaced at a predetermined relative distance (x) to the inner wall of an adjacent one of said main longitudinal frame members, said suspension openings being greater in vertical and horizontal dimension than the contours of said pins, a mounting plate associated with each said main longitudinal frame member and extending parallel thereto with openings for receiving said pins, each said mounting plate resting against said abutment surfaces and being attached to said pins, and each said mounting plate protruding in horizontal direction beyond the boundaries of said suspension openings of said shaving foil.

13. The exchangeable frame as claimed in claim 12, wherein the receding depth (y) of said shaving foil structure on the inner walls of said main longitudinal frame members is determined by the vertical relative distance (y) of the upper edges of said suspension openings to the upper sides of said projections.

14. The exchangeable frame as claimed in claim 13 and further including bearing structure for said mounting plates extending beyond the respective longitudinal sides of said shaving foil, said bearing surface structure being formed on said longitudinal frame members in the area of said end wall structures and wherein the respective mounting plates are fastened to said pins and are held in abutting engagement with said abutment surfaces by deforming said pins.

* * * * *